US008142310B2

(12) United States Patent
Hartcraft

(10) Patent No.: US 8,142,310 B2
(45) Date of Patent: Mar. 27, 2012

(54) ARROWHEAD ASSEMBLY WITH INTERCHANGEABLE BLADES

(75) Inventor: Terry W. Hartcraft, Fredericksburg, TX (US)

(73) Assignee: Terry W. Hartcraft, Fredericksburg, TX (US)

( * ) Notice: Subject to any disclaimer, the term of this patent is extended or adjusted under 35 U.S.C. 154(b) by 0 days.

(21) Appl. No.: 12/981,467

(22) Filed: Dec. 29, 2010

(65) Prior Publication Data

US 2011/0172041 A1 Jul. 14, 2011

Related U.S. Application Data

(60) Provisional application No. 61/293,942, filed on Jan. 11, 2010.

(51) Int. Cl.
*F42B 6/08* (2006.01)

(52) U.S. Cl. ..... 473/584; 473/583

(58) Field of Classification Search ..... 473/582, 473/583, 584

See application file for complete search history.

(56) References Cited

U.S. PATENT DOCUMENTS

| | | | | |
|---|---|---|---|---|
| 2,350,581 | A * | 6/1944 | Boose | 473/583 |
| 2,940,758 | A * | 6/1960 | Richter | 473/584 |
| 3,756,600 | A * | 9/1973 | Maleski | 473/584 |
| 4,036,499 | A * | 7/1977 | Sherwin | 473/584 |
| 4,143,876 | A | 3/1979 | Henkel | |
| 4,210,330 | A | 7/1980 | Kosbab | |
| 4,349,202 | A | 9/1982 | Scott | |
| 5,143,380 | A * | 9/1992 | Maleski | 473/584 |
| 5,145,186 | A | 9/1992 | Maleski | |
| 5,353,068 | A | 10/1994 | Moriwake | |
| 5,494,298 | A | 2/1996 | Maleski | |
| 5,636,845 | A | 6/1997 | Newman | |
| 6,077,180 | A | 6/2000 | Adams, Jr. | |
| 6,866,600 | B1 | 3/2005 | Johnson | |
| 7,179,182 | B2 | 2/2007 | Summers | |
| 7,182,706 | B2 | 2/2007 | Barrie | |
| 7,314,419 | B2 * | 1/2008 | Grace et al. | 473/583 |
| 7,374,505 | B2 | 5/2008 | Polando | |
| 7,422,533 | B1 | 9/2008 | Johnson | |

* cited by examiner

*Primary Examiner* — John Ricci

(57) ABSTRACT

The arrowhead assembly has a ferrule having a tip end and an arrow end. The arrow end is structured and arranged to couple to an arrow shaft. The ferrule has plural slots or grooves extending longitudinally. The grooves receive blades. Each blade has a front portion and a rear portion. The front portion is received into a nook on the ferrule, while the rear portion forms a corner that is received by a collar on the ferrule. Some of the blades have first and second cutting edges, wherein the second cutting edge is inserted into the groove while the first cutting edge is exposed for cutting. The blades are reversible in that the first cutting edge can be put into the groove while the second cutting edge is exposed. The grooves have an edge keeper to prevent the cutting edge from becoming dulled through contact through the ferrule. There are also disclosed lopper type blades which have cutting edges swept forward.

15 Claims, 2 Drawing Sheets

ARROWHEAD ASSEMBLY WITH INTERCHANGEABLE BLADES

This application claims the benefit of provisional patent application Ser. No. 61/293,942, filed Jan. 11, 2010.

FIELD OF THE INVENTION

The present invention relates to arrowhead assemblies for use with arrows.

BACKGROUND OF THE INVENTION

Bow hunters use bows and arrows to shoot at game. Contemporary bows are of a compound design to increase the force applied to the arrow. In addition, contemporary bows have targeting equipment to increase the accuracy of the shot.

Hunters use a variety of points or arrowheads, depending on the particular game that is being sought. For example, with an elk or a deer, a broadhead point is typically used. Other points are used for smaller game.

A bow hunter typically travels light, carrying a handful of arrows and points. The arrow shafts are equipped with a female threaded insert to allow the removal and substitution of points into the arrow. The hunter can rig the arrows with the points that the hunter anticipates using. However, from time to time, the hunter may want to change out a point so as to shoot at some unanticipated game that has been sighted. Changing out a point involves unscrewing the current point from the arrow shaft and screwing in the desired point.

The hunter must either carry a wide variety of points or run the risk of not having the appropriate point for game. Adding to the need to carry a wide variety of points is the need to carry more than one point of a particular type. When an arrow is shot, the sharp edges on the point may become marred or damaged. Thus, hunters typically carry several points of each type. Carrying many points adds to the cost of hunting and the equipment that the hunter must carry.

SUMMARY OF THE INVENTION

An arrowhead assembly comprises a ferrule and plural blades. The ferrule has a tip end and an arrow end. The arrow end is structured and arranged to couple to an arrow shaft. The ferrule has plural grooves extending longitudinally. Each blade has a first cutting edge and a second cutting edge. A groove in the ferrule receives one of the first or the second cutting edge of a respective blade, wherein the other of the first or second cutting edge of the respective blade is exposed for use in penetrating a target. There is also provided a retainer that releasably couples the blades in the grooves and to the ferrule.

In accordance with one aspect, each groove has a first portion and a second portion. The second portion is deeper than the first portion. The first portion of the groove has a first width and the second portion has a second width that is narrower than the first width. The second portion prevents the one of the first or second cutting edge from contacting the ferrule.

In accordance with another aspect, the second portion forms shoulders that contact the blade at a location other than the one of the first or second cutting edge.

In accordance with still another aspect, the second portion has inclined surfaces that contact the blade at a location different than the one of the first or second cutting edge.

In accordance with still another aspect, for each of the blades, the first and second cutting edges converge toward a front portion of the blade and diverge toward a rear portion of the blade.

In accordance with still another aspect, the first and second cutting edges are each continuous between the front and rear portions.

In accordance with still another aspect, at least one of the first and second cutting edges is discontinuous between the front and rear portions.

In another aspect, the arrowhead assembly comprises a ferrule and plural blades, as well as a retainer. The ferrule has a tip end and an arrow end. The arrow end is structured and arranged to couple to an arrow shaft. The ferrule has plural grooves extending longitudinally. Each of the blades has a base portion that is received in a respective one of the grooves. Each blade has a blade portion coupled to the base portion. The blade portion has a cutting edge that is swept forward toward the ferrule tip end. The retainer releasably couples the blades in the grooves and to the ferrule.

In accordance with another aspect, the base portion is elongated along the ferrule.

In accordance with another aspect, the base portion has a base length and the blade portion has a blade length, the blade length being at least twice as long as the base length.

In accordance with another aspect, the base portion has a front end and a rear end, with the front end being between the ferrule tip end and the base portion rear end. The blade portion extends from the base portion rear end.

In accordance with another aspect, the cutting edge forms an angle with a longitudinal axis with the ferrule of 15-60 degrees.

In accordance with another aspect, an arrowhead assembly comprises a ferrule, a first set of blades, a second set of blades and a retainer. The ferrule has a tip end and an arrow end. The arrow end is structured and arranged to couple to an arrow shaft. The ferrule has plural grooves extending longitudinally. In the first set of blades, each blade has a first cutting edge and a second cutting edge. The grooves are structured and arranged to receive one of the first or second cutting edge of the respective blade, wherein the other of the first or second cutting edge of the respective blade is exposed for use in penetrating a target. In the second set of blades, each blade has a base portion and a blade portion. The base portion is structured and arranged to be received in one of the grooves. The blade portion is coupled to the base portion. The blade portion has a cutting edge that is swept forward toward the ferrule tip end. The retainer releasably couples the blades in the grooves and to the ferrule.

In accordance with another aspect, each groove has a first portion and a second portion. The second portion is deeper than the first portion. The first portion of the groove has a first width and the second portion has a second width that is narrower than the first width. The second portion prevents the one of the first or second cutting edge from contacting the ferrule.

In accordance with another aspect, the base portion has a base length and the blade portion has a blade length, the blade length being at least twice as long as the base length.

DESCRIPTION OF THE PREFERRED EMBODIMENT

Figure 1:
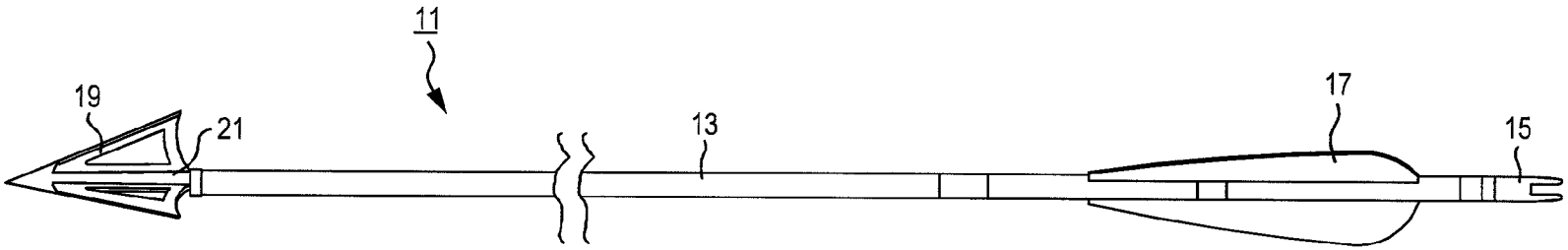
FIG. 1 is a side view of an arrow.

FIG. 1 shows an arrow 11 of the type used by archers and bow hunters. The arrow 11 has a shaft 13 with two ends. One end has a nock 15, or notch, for receiving the bow string. Close to the nock are feathers, vanes or fletching 17. The other end of the arrow has a female threaded fitting for receiving an arrowhead assembly, or point, 19.

Figure 2:
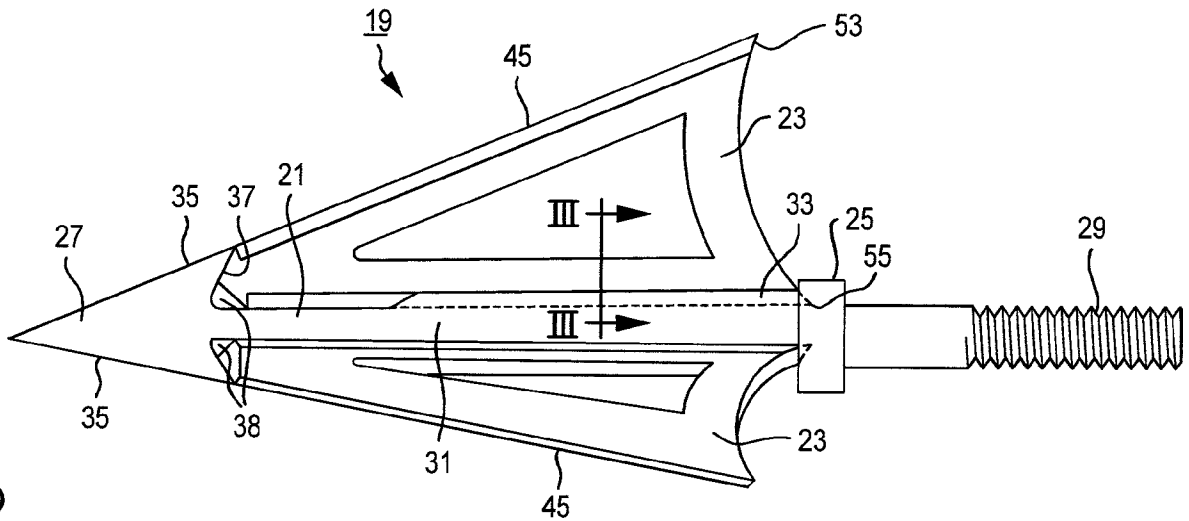
FIG. 2 is a side view of the arrowhead assembly of the present invention, in accordance with a preferred embodiment.

FIG. 2 shows the arrowhead assembly 19, which includes a ferrule 21, blades 23 and a collar 25. The arrowhead assembly allows a variety of blade types to be used with the ferrule 21. In addition, some blade types, such as that shown in FIG. 2, are reversible in the sense that two sharp edges are provided on the blade. If one edge becomes marred or dull, then the blade can simply be reversed to expose the fresh sharp edge.

In the description that follows, like reference numbers between figures indicate like components or parts.

The ferrule 21 has a front end portion 27, a rear end portion 29 and an intermediate portion 31. The front end portion 27 is pointed. The rear end portion 29 has a threaded shaft that threads into the female threaded fitting of the arrow shaft 13.

The ferrule 21 is designed to receive three to four blades. In the drawings, a three bladed ferrule is shown. The blades are spaced equidistant apart. For example, for a three bladed arrowhead, the blades are spaced 120 degrees apart. Each blade 23 is received by a longitudinal slot or groove 33 in the ferrule 21 intermediate portion 31. The blade 23 and groove 33 will be described in more detail below.

The front end portion 27 has sharp edges 35 that are aligned longitudinally with the blades 23 and grooves 33. Each sharp edge 35 extends from the pointy front tip or end rearwardly a short distance to a nook edge 37. Each nook edge 37 extends radially out from the ferrule and towards the rear end portion 29. The intersection of a nook edge 37 and respective sharp edge 35 appears as a barb when viewed from the side, as shown in FIG. 2. The nook edge 37 is not sharp and is instead blunt; the nook edge 37 and the ferrule intermediate portion 31 form a nook 38 for receiving a front portion 51 (see FIG. 4) of the blade 23. In the embodiment shown, the intermediate portion 31 has a larger diameter toward the rear end than at the nooks 38. Therefore, the grooves 33 need not extend the entire length of the intermediate portion 31.

Figure 3:
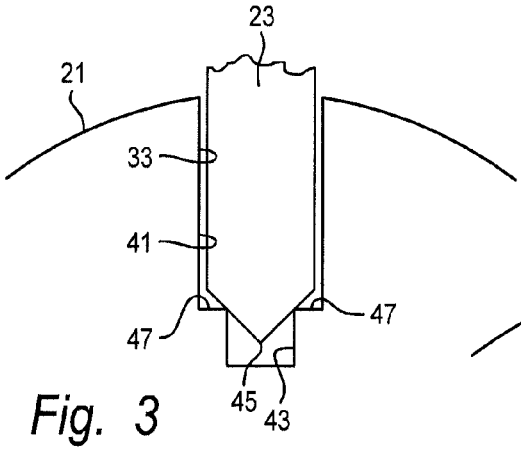
FIG. 3 is a cross-sectional view, taken at lines III-III of FIG. 2.

FIG. 3 shows a cross-sectional view of the groove 33. The groove has a first portion 41 which has straight parallel sides and forms an interference or friction fit with the blade 23. The first portion 41 is intermediate the outside surface of the ferrule and a second portion 43 of the groove. That is to say the second portion 43 is deeper than the first portion 41. Thus, when inserting a blade into the groove, the blade edge enters the first portion before entering the second portion. The second portion 43 is narrower and serves as an edge keeper, wherein the sharp edge or cutting edge 45 of the blade 23 is not in contact with the ferrule. Thus, the sharp edge is not nicked or dulled or marred by the ferrule. The second portion 43 is reduced in width by way of shoulders 47. The shoulders 47 contact the blade at a location that is away from the sharp edge 45.

Figure 3A:
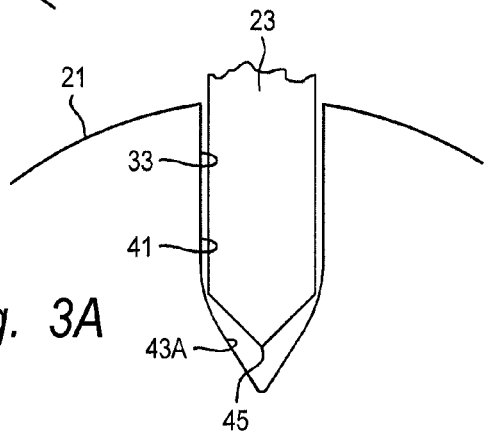
FIG. 3A is a cross-sectional view, similar to FIG. 3, but in accordance with another embodiment.

FIG. 3A shows another embodiment of the groove having first and second portions 41, 43A. The second portion 43A has side walls that are separated by a smaller angle than the angle forming the blade edge 45, so that the side walls of the groove contact the blade away from the edge 45.

Figure 4:
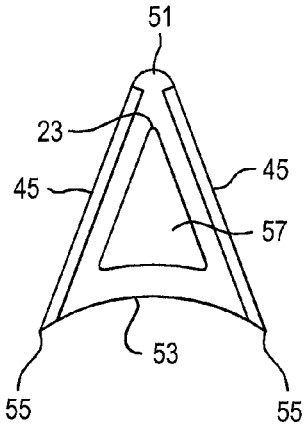
FIG. 4 is a plan view of one type of blade.

Several types or sets of blades are provided. One type of blade 23, shown in FIGS. 2 and 4, is generally triangular in shape and is typically used for big game. The blade 23 has a front end 51, a rear end or edge 53 and sharp edges 45 that extend from the front end 51 to the rear end 53. The blade 23 is symmetrical and has two sharp edges 45, thereby making the blade reversible in the sense that either edge 45 can be used. The front end 51 is shaped to be received by the nook 38 of the ferrule. Because the front portion 51 is located in the nook 38, it need not be sharp or pointed. A corner 55 is formed where each sharp edge 45 merges with the rear end 53. The rear end 53 can be concave to form a more acute corner 55 or barb. A hole 57 is provided in the center to reduce the weight of the blade 23.

The blade 23 can be made in several sizes. For example, an arrowhead assembly equipped with one size blade can be 1⅛ inches wide, while an arrowhead assembly equipped with a larger size blade can be 1½ inches wide. Arrowhead assembly width is measured in the diameter of the cut.

The collar 25 (see FIG. 2) is annular or ring shaped. The collar has a recess formed on one side, namely the side that faces the blades 23, so as to receive the corners 55 of the blades.

Figure 5:
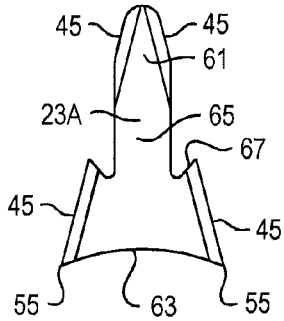
FIG. 5 is a plan view of another type of blade.

FIG. 5 shows another type of blade 23A. This type of blade can be used on small game. The blade 23A is symmetrical and has a front portion 61, a rear portion 63 and an intermediate portion 65. The rear portion 63 is wider than the front and intermediate portions 61, 65. The front portion 61 is shaped to be received by the nook 38 of the ferrule. The blade has a sharp edge 45 along each side, which edge extends along the front portion 61 and along the rear portion 63. Thus, the blade is reversible so that either edge 45 can be used. The sharp edge 45 is not continuous and has a gap at the intermediate portion 65. This gap forms a forward swept hook 67 on the rear portion. A rear corner 55 is formed on each side of the blade.

Figure 6:
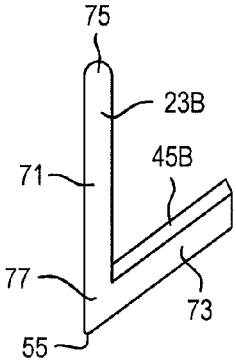
FIG. 6 is a plan view of still another type of blade.

FIG. 6 shows another type of blade 23B. This is a mid-range blade and can be used on turkey, varmints and predators such as coyotes. The blade 23B has a base portion 71 and a blade portion 73, which are joined together in an asymmetrical "V" shape. The blade portion 73 sweeps forward toward the ferrule front end portion 27 and has a sharp edge 45B on the forward or leading edge.

Figure 7:
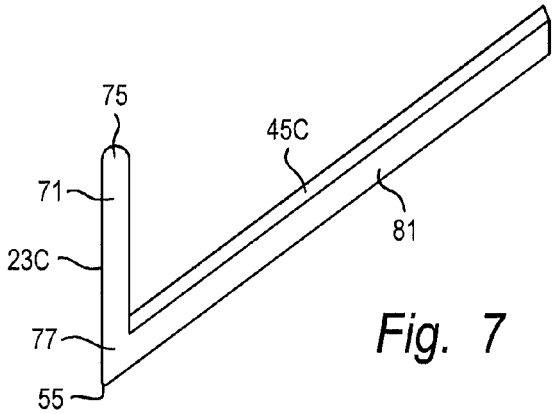
FIG. 7 is a plan view of still another type of blade.

FIG. 7 shows another blade 23C which is similar to, but larger than, the blade 23B of FIG. 6. The blade 23C is shaped like a check mark and also has a base portion 71 and a long blade portion 81. The blade portion 81 sweeps forward and has a sharp edge 45C. The blade 23C can be used to remove the head from a turkey. FIGS. 6 and 7 are lopper type blades.

Both blades 23B, 23C have a front end 75 on the base portion 71 that is shaped to be received by the nook 38 of the ferrule. The blade portions 71 on both blades 23B, 23C is elongated between the front and rear ends. Both blades have the blade portion 73, 81 extending from the rear end of the base portion so as to form a corner 55, which corner can be received by the collar 25.

The base portion 71 has a length between its front and rear ends. Each blade portion 81 cutting edge 45 also has a length. In the preferred embodiment, the length of the cutting edge 45 is at least twice as long as the length of the base portion 71.

The blades 23B and 23C have the blade portions 73, 81 angled between 15 to 60 degrees relative to the respective base portion 71. The base portions are collinear with the center line of the arrow. In the preferred embodiment, the blade portion is angled at 37 degrees with respect to the base portion. The forward swept blades cause considerable damage to game. For example, if the arrow is shot into the vital organ area of game, then the vital organs will experience considerable damage. This causes the animal to succumb quickly. Furthermore, the forward swept blades minimize the possibility that the arrow point will shoot through the animal. Instead, the arrowhead will remain in the animal.

The blades 23, 23A, 23B and 23C have equal thicknesses, at least along the portions that are inserted into the grooves. The center portions of the blades 23 and 23A need not be of the same thickness as the edge portions. Likewise, the blade portions 73, 81 of the blades 23B, 23C need not be of the same thickness as the base portion 71.

The assembly and use of the arrowhead assembly 19 will now be discussed. To configure the arrowhead assembly of FIG. 2, a blade 23 is located in each groove. One of the edges of the blade is inserted into the respective groove; as shown in FIG. 3, the edge 45 itself does not contact the ferrule, wherein the edge is protected and preserved. The front end 51 of the blade is inserted into the nook 38. The interference fit between the blade and the groove holds the blade in place during assembly, while the other blades are put into the ferrule. Once all of the blades have been put into the ferrule, the collar 25 is put on to the rear end portion 29 and moved forward. The collar recess captures the respective corners 53 of the blades. The assembly is then threaded onto an arrow shaft until the collar is firmly seated and the blades are secure.

In use, the blades 23 are securely held. The grooves 33 prevent side to side, or lateral, movement of the blades. Any fore and aft movement of the blades are prevented by the respective nooks 38 and the collar 25.

To remove a blade from the arrowhead assembly, the assembly is unscrewed a short distance from the arrow shaft to loosen the collar. The blades can then be removed from the grooves. The blades 23 can be reversed and reused, wherein the edge 45 that was in the groove is now exposed and the formally exposed edge is located in the groove. Alternatively, the blade can be replaced with a similar blade or with another blade type.

The blade 23A is inserted into the ferrule by locating the edge 45 in the groove and the front 61 in the nook 38. The collar secures the respectively corner 55.

The blades 23B and 23C are inserted into the ferrule by locating the base portion 71 in the groove 33 and the front 75 in the nook 38. The collar 25 secures the corner 55 of each blade.

The blade 23 preferably has an edge 45 that aligns with and is somewhat collinear with the front edge 35 (FIG. 2) of the ferrule. This arrangement provides a clean edge line along the ferrule and the blade. Likewise, the blade 23A preferably has a similar clean edge line between the ferrule edge 35 and the blade edges 45. Of course the gap between the blade edges 45 and the resulting hook 67 prevent a continuous edge line.

In practice, the blades can be reversed or replaced on the arrowhead assembly in a very short period of time. This allows the hunter to carry a minimal amount of equipment and to adapt the point equipment to the conditions he encounters in the field.

The foregoing disclosure and showings made in the drawings are merely illustrative of the principles of this invention and are not to be interpreted in a limiting sense.

The invention claimed is:

1. An arrowhead assembly, comprising:

a) a ferrule having a tip end and an arrow end, the arrow end structured and arranged to couple to an arrow shaft, the ferrule having plural grooves extending longitudinally;

b) plural blades, with each blade having a first cutting edge and a second cutting edge; the grooves receiving one of the first or second cutting edge of the respective blade, wherein the other of the first or second cutting edge of the respective blade is exposed for use in penetrating a target;

c) a retainer that releasably couples the blades in the grooves and to the ferrule.

2. The arrowhead assembly of claim 1 wherein each groove has a first portion and a second portion, the second portion being deeper than the first portion, the first portion having a first width and the second portion having a second width that is narrower than the first width, the second portion preventing the one of the first or second cutting edge from contacting the ferrule.

3. The arrowhead assembly of claim 2 wherein the second portion forms shoulders that contact the blade at a location other than the one of the first or second cutting edge.

4. The arrowhead assembly of claim 2 wherein the second portion has inclined surfaces that contact the blade at a location different than the one of the first or second cutting edge.

5. The arrowhead assembly of claim 1 wherein for each of the blades, the first and second cutting edges converge toward a front portion of the blade and diverge toward a rear portion of the blade.

6. The arrowhead assembly of claim 5 wherein the first and second cutting edges are each continuous between the front and rear portions.

7. The arrowhead assembly of claim 5 wherein at least one of the first and second cutting edges are discontinuous between the front and rear portions.

8. An arrowhead assembly, comprising:

a) a ferrule having a tip end and an arrow end, the arrow end structured and arranged to couple to an arrow shaft, the ferrule having plural grooves extending longitudinally;

b) plural blades, with each blade having a base portion that is received in a respective one of the grooves, each blade having a blade portion coupled to the base portion, the blade portion having a cutting edge that is swept forward toward the ferrule tip end;

c) a retainer that releasably couples the blades in the grooves and to the ferrule.

9. The arrowhead assembly of claim 8 wherein the base portion is elongated along the ferrule.

10. The arrowhead assembly of claim 9 wherein the base portion has a base length and the blade portion has a blade length, the blade length being at least twice as long as the base length.

11. The arrowhead assembly of claim 8 wherein the base portion has a front end and a rear end, with the front end being between the ferrule tip end and the base portion rear end, the blade portion extending from the base portion rear end.

12. The arrowhead assembly of claim 8 wherein the cutting edge forms an angle with a longitudinal axis with the ferrule of 15-60 degrees.

13. An arrowhead assembly, comprising:

a) a ferrule having a tip end and an arrow end, the arrow end structured and arranged to couple to an arrow shaft, the ferrule having plural grooves extending longitudinally;

b) a first set of blades, with each blade having a first cutting edge and a second cutting edge, with the grooves being structured and arranged to receive one of the first or second cutting edges, wherein the other of the first or second cutting edge of the respective blade is exposed for use in penetrating a target;

c) a second set of blades, with each of the second set of blades having a base portion that is structured and arranged to be received in a respective one of the grooves, with each second set of blades having a blade portion coupled to the base portion, the blade portion having a cutting edge that is swept forward toward the ferrule tip end;

d) a retainer that releasably couples the blades in the grooves and to the ferrule.

14. The arrowhead assembly of claim 13 wherein each groove has a first portion and a second portion, the second portion being deeper than the first portion, the first portion having a first width and the second portion having a second width that is narrower than the first width, the second portion preventing the one of the first or second cutting edge from contacting the ferrule.

15. The arrowhead assembly of claim 13 wherein the base portion is elongated along the ferrule.

* * * * *